US010178938B2

(12) United States Patent
Bhajak et al.

(10) Patent No.: US 10,178,938 B2
(45) Date of Patent: Jan. 15, 2019

(54) DISHWASHER WITH A PIVOT SYSTEM FOR A DISH RACK

(71) Applicant: Whirlpool Corporation, Benton Harbor, MI (US)

(72) Inventors: Harshal J. Bhajak, Saint Joseph, MI (US); Christopher C. Wilcox, Stevensville, MI (US)

(73) Assignee: Whirpool Corporation, Benton Harbor, MI (US)

( * ) Notice: Subject to any disclaimer, the term of this patent is extended or adjusted under 35 U.S.C. 154(b) by 1131 days.

(21) Appl. No.: 14/132,532

(22) Filed: Dec. 18, 2013

(65) Prior Publication Data

US 2014/0102491 A1 Apr. 17, 2014

Related U.S. Application Data

(63) Continuation of application No. 13/425,454, filed on Mar. 21, 2012, now Pat. No. 9,282,877.

(51) Int. Cl.

| | |
|---|---|
| ***A47L 15/26*** | (2006.01) |
| ***A47L 15/50*** | (2006.01) |
| *A47L 15/42* | (2006.01) |

(52) U.S. Cl.

CPC ..... *A47L 15/26* (2013.01); *A47L 15/50* (2013.01); *A47L 15/507* (2013.01); *A47L 15/4257* (2013.01)

(58) Field of Classification Search

USPC ..... 211/41.9

See application file for complete search history.

(56) References Cited

U.S. PATENT DOCUMENTS

| | | | | |
|---|---|---|---|---|
| 3,087,769 | A | 4/1963 | Guth | |
| 3,146,045 | A | 8/1964 | Kauffman | |
| 3,321,261 | A | 5/1967 | Guth | |
| 5,115,822 | A | 5/1992 | Nichols | |
| 5,971,513 | A | 10/1999 | Cassalia | |
| 7,594,513 | B2 | 9/2009 | Vanderroest et al. | |
| 7,621,605 | B2 | 11/2009 | Bond et al. | |
| 7,628,461 | B2 | 12/2009 | Carden et al. | |
| 7,731,805 | B2 | 6/2010 | Banta et al. | |
| 7,775,378 | B2 * | 8/2010 | Tynes | A47L 15/504 211/41.8 |
| 2004/0163687 | A1 | 8/2004 | Son et al. | |
| 2009/0007374 | A1 * | 1/2009 | Tynes | A47L 15/4261 16/223 |
| 2009/0038657 | A1 * | 2/2009 | Kang | A47L 15/502 134/137 |
| 2009/0151758 | A1 * | 6/2009 | Kristensson | A47L 15/507 134/201 |
| 2012/0104914 | A1 | 5/2012 | Jobst et al. | |

FOREIGN PATENT DOCUMENTS

| | | |
|---|---|---|
| EP | 1066789 B1 | 4/2004 |
| EP | 1744656 B1 | 3/2009 |

* cited by examiner

*Primary Examiner* — Rita P Adhlakha

(74) *Attorney, Agent, or Firm* — McGarry Bair PC

(57) ABSTRACT

A dishwasher includes a slide system for sliding movement of a dish rack in and out of a wash chamber, and a pivot system to enable cooperative pivoting of the dish rack and an access door when the dish rack at least partially overlies the door and the door is pivoted from an opened to a closed position.

20 Claims, 13 Drawing Sheets

DISHWASHER WITH A PIVOT SYSTEM FOR A DISH RACK

CROSS-REFERENCE TO RELATED APPLICATION

This application is a continuation-in-part of U.S. patent application Ser. No. 13/425,454, filed Mar. 21, 2012, now U.S. Pat. No. 9,282,877 which is incorporated herein by reference in its entirety.

BACKGROUND OF THE INVENTION

A dish rack of a dishwasher is frequently extended out of the dishwasher by pulling it on wheels that roll across the inner surface of the open door. The action of closing the door while the dish rack overlies a portion of the door may inhibit the closing of the door because of the weight of the loaded dish rack and/or the binding of the dish rack relative to the door as the dish rack is designed to roll on a horizontal surface. If sufficient force is applied to the door to overcome the weight of the loaded dish rack, the dish rack may slide very quickly backward until encountering a stop, such as wheel stops or the rear wall of the tub, which may jostle the rack and its contents, increasing the likelihood of the items becoming improperly positioned for cleaning or the dish rack skewing or racking in such a manner to inhibit door closure or proper cleaning.

Where a rail system is utilized for the dish rack, the problems may be exacerbated in that movement of the door may cause binding of the rails. When an attempt is made to close the door before the rack is fully retracted into the dishwasher, contact of the door with an extended rail section, particularly with a telescopic rail configuration, may tend to force the extended rail section upward, causing the telescopic rails to bind, and preventing the movement of either the door or the rail.

BRIEF DESCRIPTION

An embodiment of the invention relates to a dishwasher for treating dishes according to a cycle of operation comprises a tub at least partially defining a wash chamber with an open face, a door moveable between an open position and closed position, a dish rack, a slide system, a pivot system and at least one contact element, wherein the slide system slidably coupes the dish rack to the tub for sliding movement of the dish rack in and out of the wash chamber through the open face.

DESCRIPTION OF EMBODIMENTS OF THE INVENTION

Figure 1:
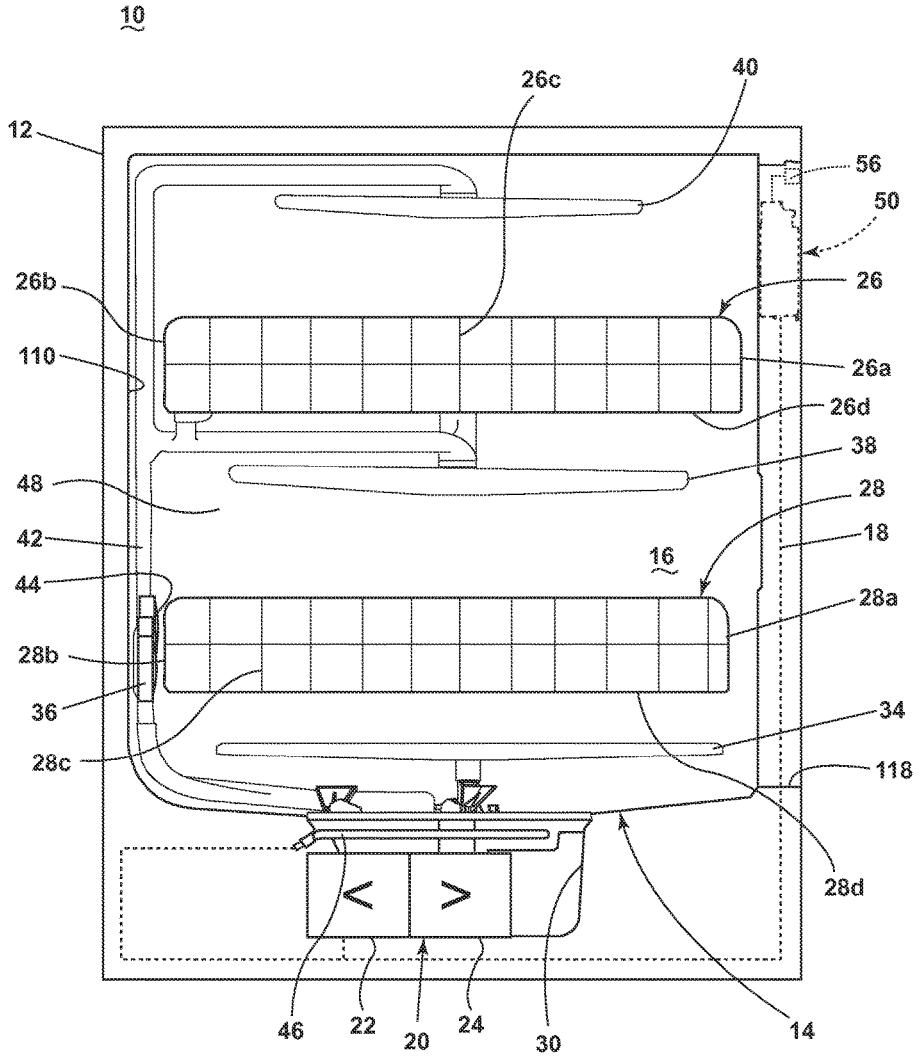
FIG. 1 is a schematic, cross-sectional view of a dishwasher according to an embodiment of the invention.

In FIG. 1, an automated dishwasher 10 is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 having side walls 48 may be provided within the chassis 12, and may at least partially define a treating chamber 16, having an open face 118 defining an access opening, for washing dishes. A door assembly 18 may be movably mounted to the dishwasher 10 for movement between opened and closed positions to selectively open and close the open face 118. Thus, the door assembly 18 provides accessibility to the treating chamber 16 for the loading and unloading of dishes or other washable items. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, respectively, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

The dish racks 26, 28 may be a wireframe structure having a front wall 26*a*, 28*a*, a rear wall 26*b*, 28*b*, a pair of opposing side walls 26*c*, 28*c*, and a bottom wall 26*d*, 28*d*. When the racks 26, 28 are received within the treating chamber 16, the front wall 26*a*, 28*a* may be adjacent the open face 118 and the rear wall 26*b*, 28*b* may be adjacent the back wall 110 of the tub 14.

A spray system may be provided for spraying liquid in the treating chamber 16 and may be provided in the form of a first lower spray assembly 34, a second lower spray assembly 36, a mid-level spray assembly 38, and/or an upper spray assembly 40. Upper spray assembly 40, mid-level spray assembly 38, and lower spray assembly 34 are located, respectively, above the upper rack 26, beneath the upper rack 26, and beneath the lower rack 28, and are illustrated as rotating spray arms. The second lower spray assembly 36 is illustrated as being located adjacent the lower dish rack 28 toward the back wall 110 of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system may be provided for recirculating liquid from the treating chamber 16 to the spray system. The recirculation system may include a sump 30 and a pump assembly 20. The sump 30 collects liquid sprayed in the treating chamber 16 and may be formed by a sloped or recessed portion of a bottom wall of the tub 14. The pump assembly 20 may include both a drain pump 22 and a recirculation pump 24. The drain pump 22 may draw liquid from the sump 30 and pump the liquid out of the dishwasher 10 to a household drain line (not shown). The recirculation pump 24 may draw liquid from the sump 30, and the liquid may be simultaneously or selectively pumped through a supply tube 42 to each of the spray assemblies 34, 36, 38, 40 for selective spraying. Though not shown, a liquid supply system may be fluidly coupled with the recirculation system, and may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located elsewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50, and receive information.

Figure 2:
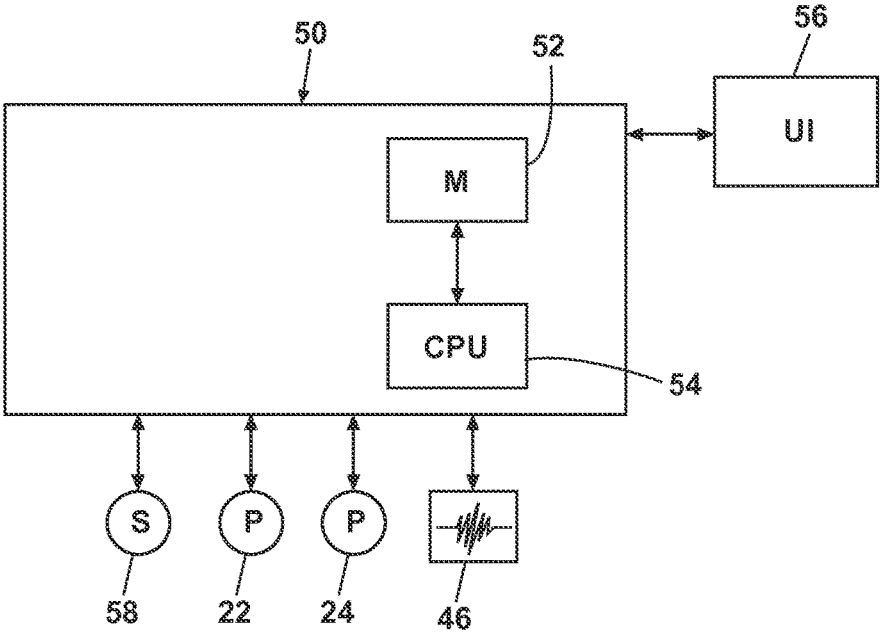
FIG. 2 is a schematic view of a controller of the dishwasher of FIG. 1.

As illustrated schematically in FIG. 2, the controller 50 may be coupled with the heater 46 for heating the wash liquid during a cycle of operation, the drain pump 22 for draining liquid from the treating chamber 16, and the recirculation pump 24 for recirculating the wash liquid during a cycle of operation. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and a turbidity sensor to determine the soil load associated with a selected grouping of dishes, such as the dishes associated with a particular area of the treating chamber.

Figure 3:
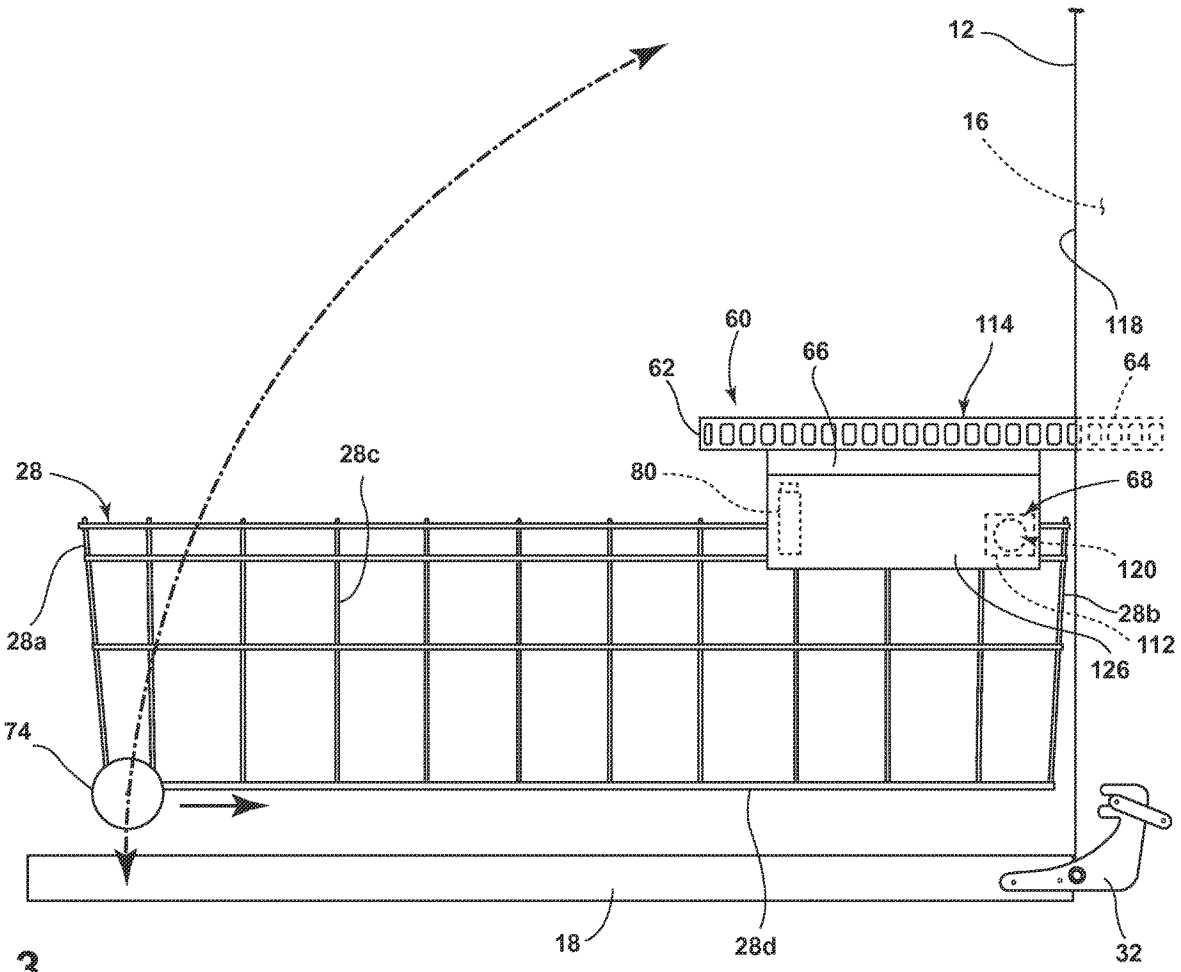
FIG. 3 is a schematic elevation view of a portion of a dishwasher including a dish rack incorporating a dish rack pivot system in an unpivoted configuration according to a first embodiment of the invention.

FIGS. 3-6 illustrate a first embodiment of a dish rack pivot system for use in the dishwasher 10 that enables the pivoting of the dish rack with the door. Referring to FIG. 3, the door assembly 18 may be secured to the lower front edge of the chassis 12 or to the lower front edge of the tub 14 via a hinge assembly 32 configured to pivot the door as illustrated by the arcuate arrow. The first embodiment is described in detail and is illustrated as including a slide system 60 and a pivot system 68, which are shown coupling the lower dish rack 28 to the tub in a manner to enable the relative pivoting of the lower dish rack 28 and the door assembly 18. While the upper dish rack 26 is omitted for purposes of clarity, it should be noted that the pivot system 68 may be applied to the upper dish rack 26 as well as the lower dish rack 28.

Figure 4:
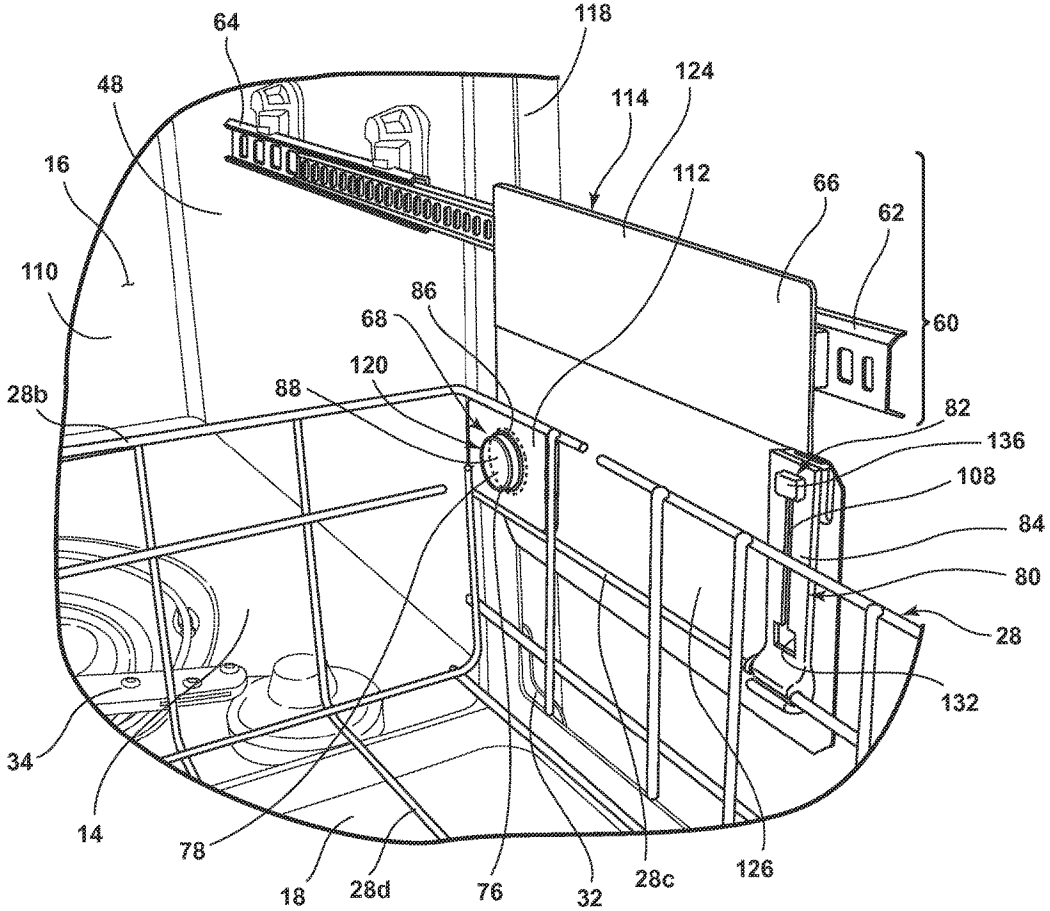
FIG. 4 is an enlarged perspective view of a portion of the dishwasher illustrated in FIG. 3 showing the dish rack, a slide system, and the pivot system, attached to the dish rack in an unpivoted configuration according to the first embodiment of the invention.
Figure 5:
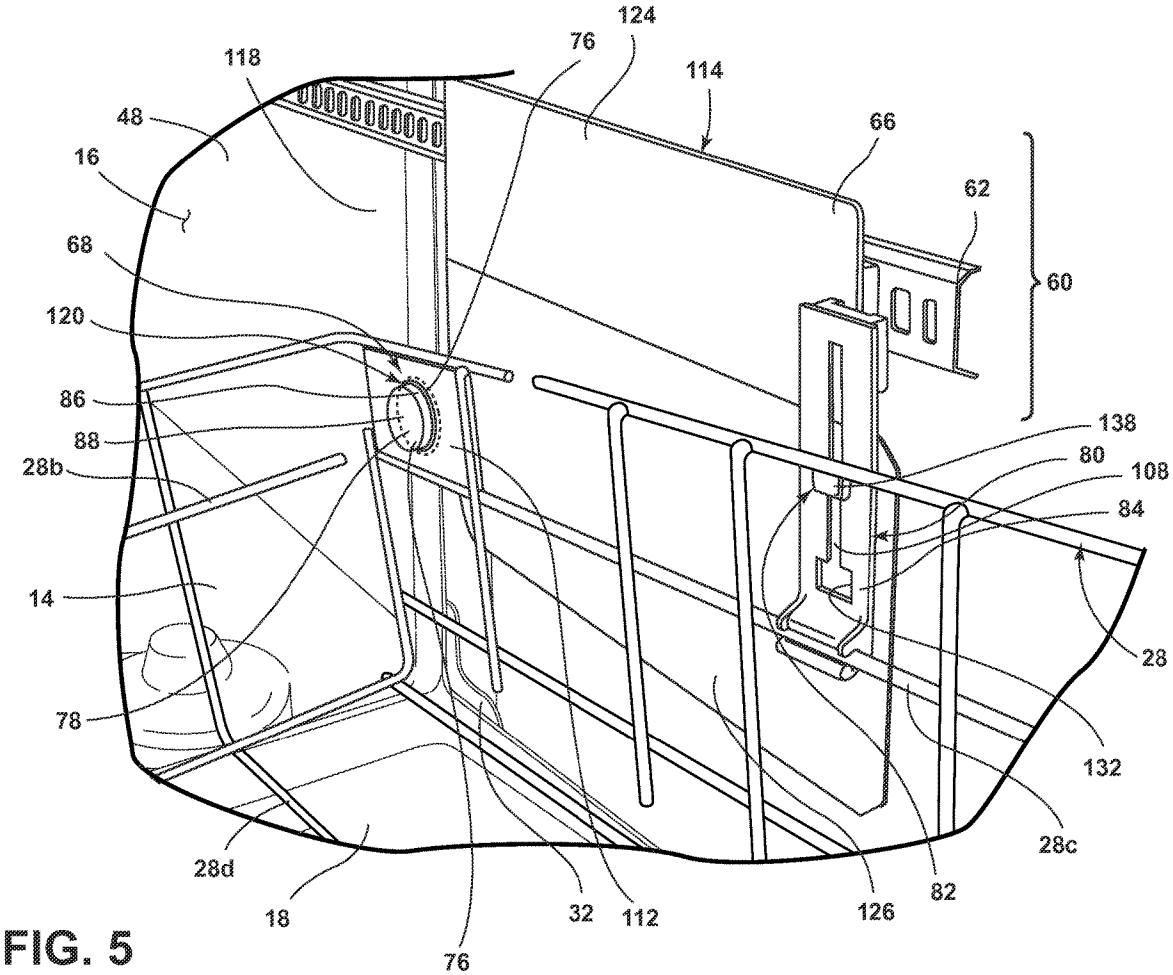
FIG. 5 is an enlarged perspective view of the dishwasher illustrated in FIG. 4 showing the dish rack, slide system, and pivot system in a pivoted configuration according to the first embodiment of the invention.

Referring also to FIG. 4, the slide system 60 may comprise a pair of slide system assemblies, which may be mirror-images of each other, each of which may be attached horizontally to a side wall 48 of the tub 14. Since each slide system assembly operates in the same manner, only 1 slide system assembly 114 is illustrated and described. The slide system assembly 114 may include a first rail 62 and a second rail 64 in telescopic disposition, and a transition element 66. The second rail 64 may be fixedly attached to a side wall 48 of the tub 14 within the treating chamber 16, and may telescopically support the first rail 62 to enable the first rail 62 to slidably move into and out of the treating chamber 16.

The transition element 66 may be a generally bracket-like or plate-like body including a first portion 124 adapted for coupling with the first rail 62, and a second portion 126 adapted for coupling with a side wall 28*c* of the dish rack 28. The first portion 124 may be coupled with the first rail 62 through any suitable means having sufficient strength and durability for the purposes described herein. For example, the first portion 124 may be coupled with the first rail 62 through fasteners, such as threaded fasteners, rivets, snap fittings, and the like, by welding, by integrating the first portion 124 into the first rail 62, or through an assembly of rollers or bearings adapted for movement of the transition element 66 along the first rail 62.

The second portion 126 may be coupled with the dish rack 28 through the pivot system 68. The pivot system 68 may comprise a pair of pivot assemblies 120, which may be mirror-images of each other. Since each pivot assembly operates in the same manner, only 1 pivot assembly 120 is illustrated and described. The pivot assembly 120 may include first and second pivot couplings 76, 78, which pivotally couple the dish rack to the slide system assembly 114. The first pivot coupling 76 is illustrated as a plate 112 affixed to the rack with an annular hub 86. The second pivot coupling 78 is illustrated as an axle 88 affixed to the transition element 66 and extending therefrom to be received within the annular hub 86, whereby the axle 88 may rotate within the hub 86 to provide for relative pivoting between the rack and the slide assembly. The hub 86 and axle 88 may be adapted with dimensions such that the outer diameter of the axle 88 is somewhat less than the inner diameter of the hub 86 so that the axle 88 may slidably pivot within the hub 86 with minimal wobble. The axle 88 may be provided with a low friction sleeve (not shown) to facilitate pivoting of the axle 88 within the hub 86.

One of the hub 86 and the axle 88 may be fixedly coupled with the second portion 126 of the transition element 66, toward a rear portion thereof (i.e. adjacent the rack rear wall 28*b*), and the other of the hub 86 and the axle 88 may be fixedly coupled with a side wall 28*c* of the dish rack 28. FIG. 4 illustrates an example of the hub 86 coupled with and extending orthogonally from the pivot plate 112, which may be fixedly coupled with the side wall 28*c* near the rear wall 28*b*.

The pivot plate 112 may include a circular opening (not shown) coaxially aligned with the attached hub 86. The hub 86 may be coupled with the pivot plate 112, and the pivot plate 112 with the side wall 28*c*, through any suitable means such as welding, fasteners, clips, or clamps, or by integrating the pivot plate 112 with the side wall 28*c* during manufacturing of the dish rack 28. The axle 88 may be coupled with the second portion 126 through any suitable means such as welding, casting, fasteners, and the like. In this configuration, the axle 88 may extend from the transition element 66 into the hub 86 for relative pivoting.

An optional vertical slider 80 may further couple the dish rack side wall 28*c* with the second portion 126 of the transition element 66 while enabling the pivoting action described above. The slider 80 may comprise a pin 82 and a channel element 84. The channel element 84 may be an elongate rectangle-shaped plate-like body having a slot 108 extending longitudinally therealong, stopping short of each end of the channel element 84. A first end of the slot 108 may terminate in a rectangular opening 132 oriented transversely to the longitudinal slot 108. The channel element 84 may be fixedly coupled with the side wall 28*c* of the dish rack 28 through clips, clamps, welding, and the like, so that the slot 108 extends along the side wall 28*c* perpendicular to the top thereof. The pivot assembly 120 and the channel element 84 may be located at horizontally opposite ends, respectively, of the transition element 66.

The pin 82 may be an elongate, somewhat T-shaped member adapted for slidable engagement with the channel element 84. The pin 82 may be rigidly attached, such as by welding, perpendicular to the second portion 126 of the transition element 66. The pin 82 may terminate in a perpendicularly attached, transversely oriented flange 136 adapted for insertion through the opening 132 so that the pin 82 may slide along the slot 108, held to the channel element 84 by the flange 136.

When assembled, the first rail 62 of each slide system assembly 114 may be coupled with the first portion 124 of each transition element 66, which may extend from the first rail 62 in a downward orientation to approach the side walls 28*c* of the lower dish rack 28. The pivot assemblies 120, 122 may couple the second portion 126 of each transition element 66 with the side walls 28*c* of the lower dish rack. The pin 82 extending perpendicularly from the second portion 126 may engage the slot 108 in the channel element 84 so that the pin 82 can slide generally vertically along the slot 108 as the dish rack 28 pivots about the pivot assemblies 120, 122 from an unpivoted position shown in FIG. 4 to a pivoted position shown in FIG. 5.

The dish rack 28 may effectively pivot upwardly about the axle 88, and while doing so, the pin 82 may slide downwardly along the slot 108. Pivoting of the dish rack 28 may be limited by contact of the pin 82 with the end of the slot 108.

Figure 6:
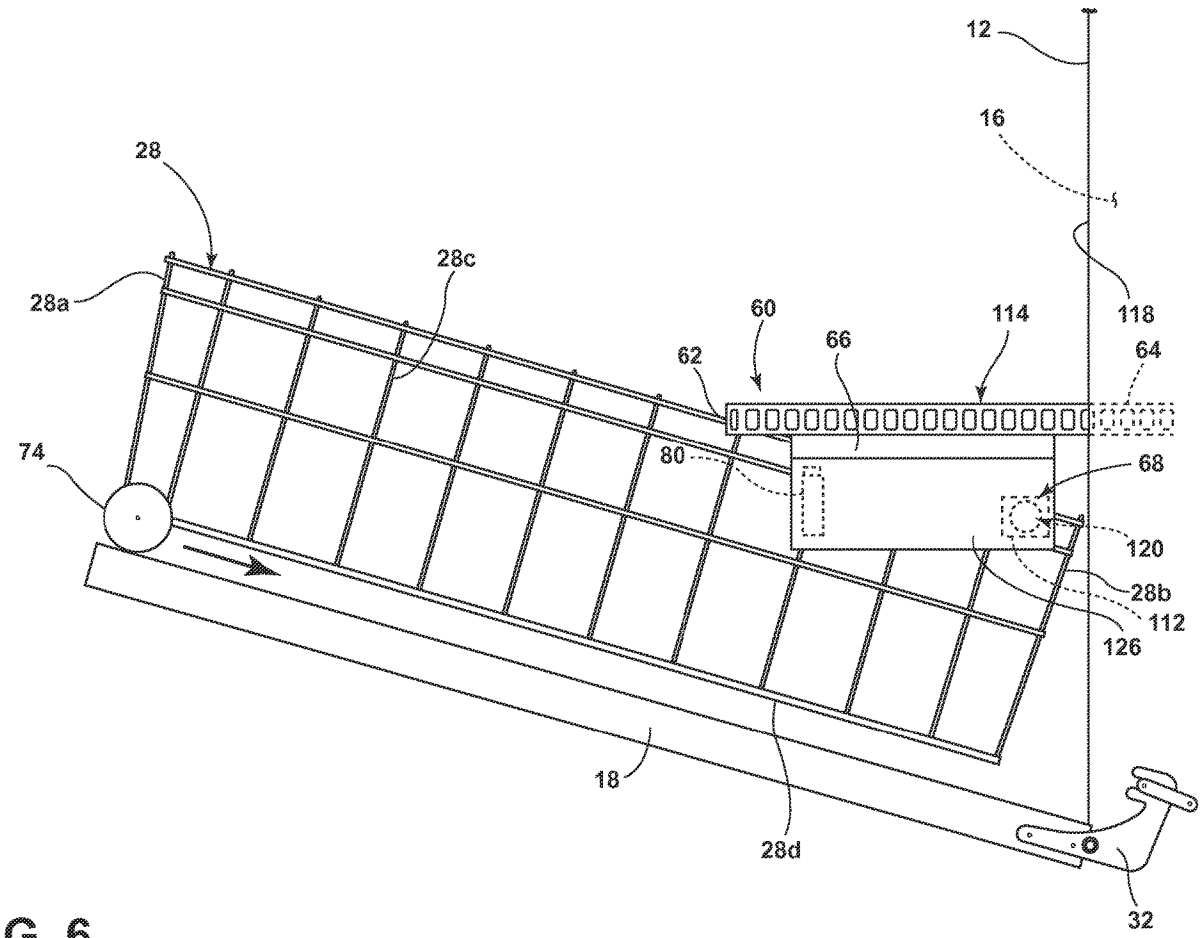
FIG. 6 is a schematic elevation view of the dishwasher of FIG. 3 showing the dish rack, pivot system, and slide system in a pivoted configuration.

Referring to FIG. 6, as the door 18 is lifted toward a closed vertical orientation, the lower dish rack 28 may be lifted with the door assembly 18 and may pivot about the pivot assembly 120. The front portion of the side walls 28*c* or bottom wall 28*d* of the dish rack 28 may be provided with a low friction contact element 74 for contact with an interior surface of the door assembly 18 to facilitate the sliding of the lower rack 28 along the door assembly 18. When the door assembly is in a horizontal, at-rest position, the dish rack 28 and contact element 74 may be suspended above the door assembly 18, as shown in FIG. 3.

Figure 7:
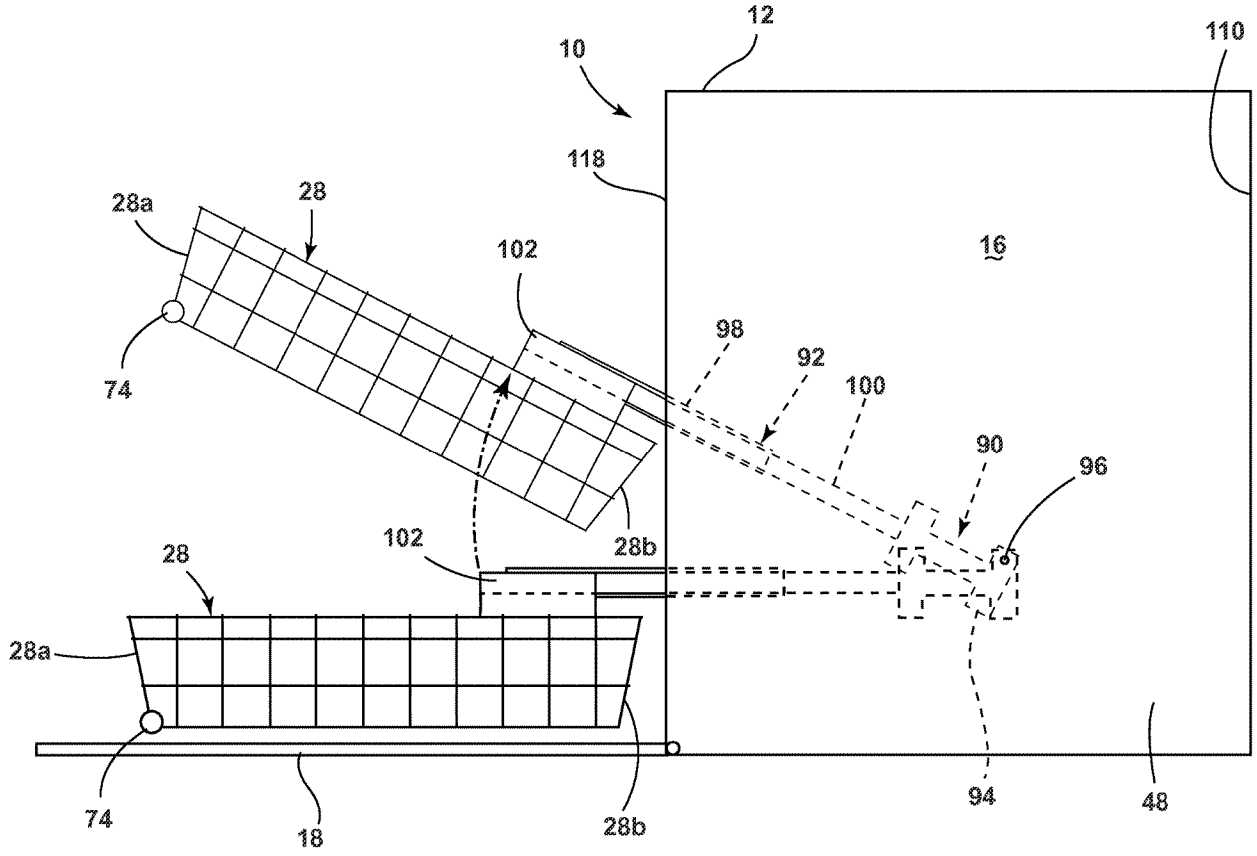
FIG. 7 is a schematic elevation view of a portion of a dishwasher including a dish rack incorporating a dish rack pivot system according to a second embodiment of the invention.

FIG. 7 schematically illustrates a second embodiment of the pivoting dish rack assembly which shares many features of the first embodiment and, therefore, descriptions of like elements will not be repeated, and like elements will be identified with like reference characters. The second embodiment differs from the first embodiment in that, rather than the dish rack 28 pivoting relative to the rails 62, 64, the dish rack 28 remains fixedly oriented relative to the rails, and the rails pivot relative to the tub side walls 48. Nevertheless, the second embodiment includes a pivot system 90 and a slide system 92.

FIG. 7 illustrates the second embodiment pivoting dish rack assembly in both the unpivoted (lower) position and the pivoted (upper) position, with the pivoting movement represented by the upwardly-directed arcuate arrow.

The slide system 92 may include a first rail 98 and a second rail 100. The first rail 98 may be fixedly coupled to a dish rack support bracket 102 using threaded fasteners, rivets, snap fittings, welds, integration, and the like. The dish rack support bracket 102 may be coupled with the dish rack 28 in a suitable manner, such as by attaching the support bracket 102 to the side walls 28*c*. Alternatively, the first rail 98 can be movably coupled with the dish rack support bracket 102 by an assembly of rollers (not shown) to enable movement of the dish rack support bracket 102 along the first rail 98. The first rail 98 may also be adapted for slidable telescopic engagement with the second rail 100.

The second rail 100 may be coupled with the pivot system 90, which may include a first pivot coupling 94 and a second pivot coupling 96. The second pivot coupling 96 may be fixedly attached to a tub side wall 48, and may be pivotably coupled with the first pivot coupling 94 for pivoting of the first pivot coupling 94 relative to the second pivot coupling 96. As an example, the second pivot coupling 96 may include an axle or pin (not shown) and the first pivot coupling 94 may include a hub (not shown) for pivotable register. Thus, the slide system 92 may pivot relative to the side walls 48, with the second rail 100 slidably fixed relative to the tub side wall 48.

With the door assembly 18 open, the lower dish rack 28 may be fully extended out of the treating chamber 16 by telescopic movement of the first rail 98 relative to the second rail 100. As the door assembly 18 is lifted to close the dishwasher 10, the low friction contact element 74 may contact the inner surface of the door assembly 18 so that the lower dish rack 28 may be lifted by inclination of the slide system 92 and pivoting of the first pivot coupling 94 relative to the second pivot coupling 96, enabling the lower dish rack 28 to move along the slide system 92 into the treating chamber 16.

With the first embodiment, lifting of the door assembly 18 may pivot the lower dish rack 28 to an inclined disposition relative to the slide system 60. Pivoting of the dish rack 28 may tend to urge the dish rack 28 into the treating chamber 16. However, the first rail 62 must also horizontally telescope along the second rail 64 for the dish rack 28 to enter the treating chamber 16. With the second embodiment, lifting of the door assembly 18 may pivot the lower dish rack 28 and the slide system 92 upwardly relative to the pivot system 90. The pivoting of the dish rack 28 and the slide system 92 to the same inclination may urge the dish rack 28 into the treating chamber 16 by telescopic movement of the first rail 62 relative to the second rail 64.

Figure 8:
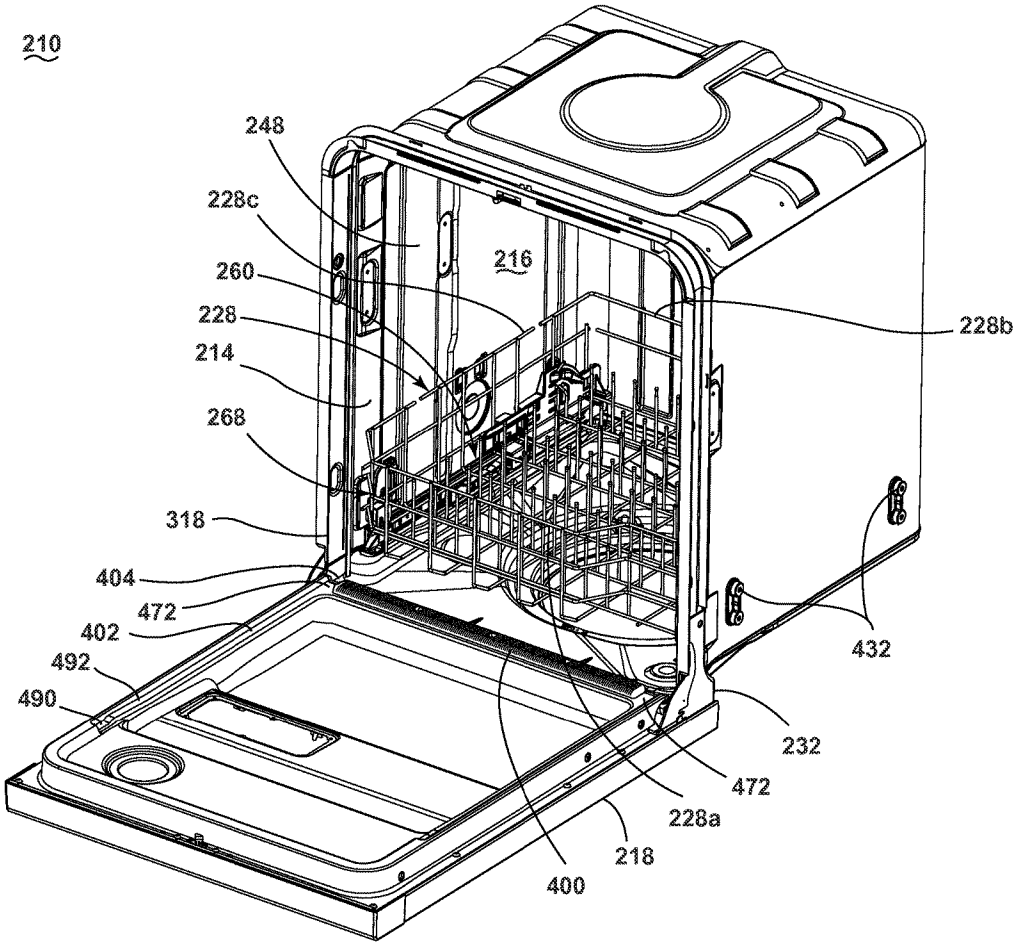
FIG. 8 is a perspective view of a dishwasher including a dish rack incorporating a dish rack pivot system according to a third embodiment of the invention.

FIG. 8 illustrates a third embodiment of a the dish rack pivot system which shares many features of the first and second embodiments and, therefore, descriptions of like elements will not be repeated, and like elements will be identified with like reference characters. The third embodiment differs from the first embodiment in that the dish rack remains fixedly oriented relative to the rails of the slide assembly while the rails of the slide assembly pivot relative to the tub side walls. Both the second and the third embodiments describe a system in which the dish rack remains fixedly oriented relative to the rails of the slide assembly while the rails of the slide assembly pivot relative to the tub side walls with differences which will be described in further detail below.

In FIG. 8, a dishwasher 210 in which only the lower dish rack 228 is illustrated, although it will be understood that the embodiments of the invention may also be used in a similar manner with an upper dish rack. The dish rack 228 is coupled with the slide system 260 that is coupled with the tub 214 by the pivot system 268. The tub 214 includes an open face 318 through which the dish rack 228 passes as the dish rack 228 is slid in and out of the treating chamber 216 between a retracted position (illustrated in FIG. 8) and an extended position (illustrated in FIG. 13). The door assembly 218 includes a door seal 400 provided at least in part on the door assembly 218 to fluidly seal the door assembly 218 with the open face 318 of the tub 214. The door assembly 218 may further include a pair of tracks 402 provided on an inner face of the door assembly 218. The door seal 400 may optionally include gaps 404 aligned with each of the tracks 402. While the tracks 402 are described in the context of the third embodiment, it will be understood that it is within the scope of the invention for the tracks 402 to be used with either of the first or second embodiments.

Figure 9:
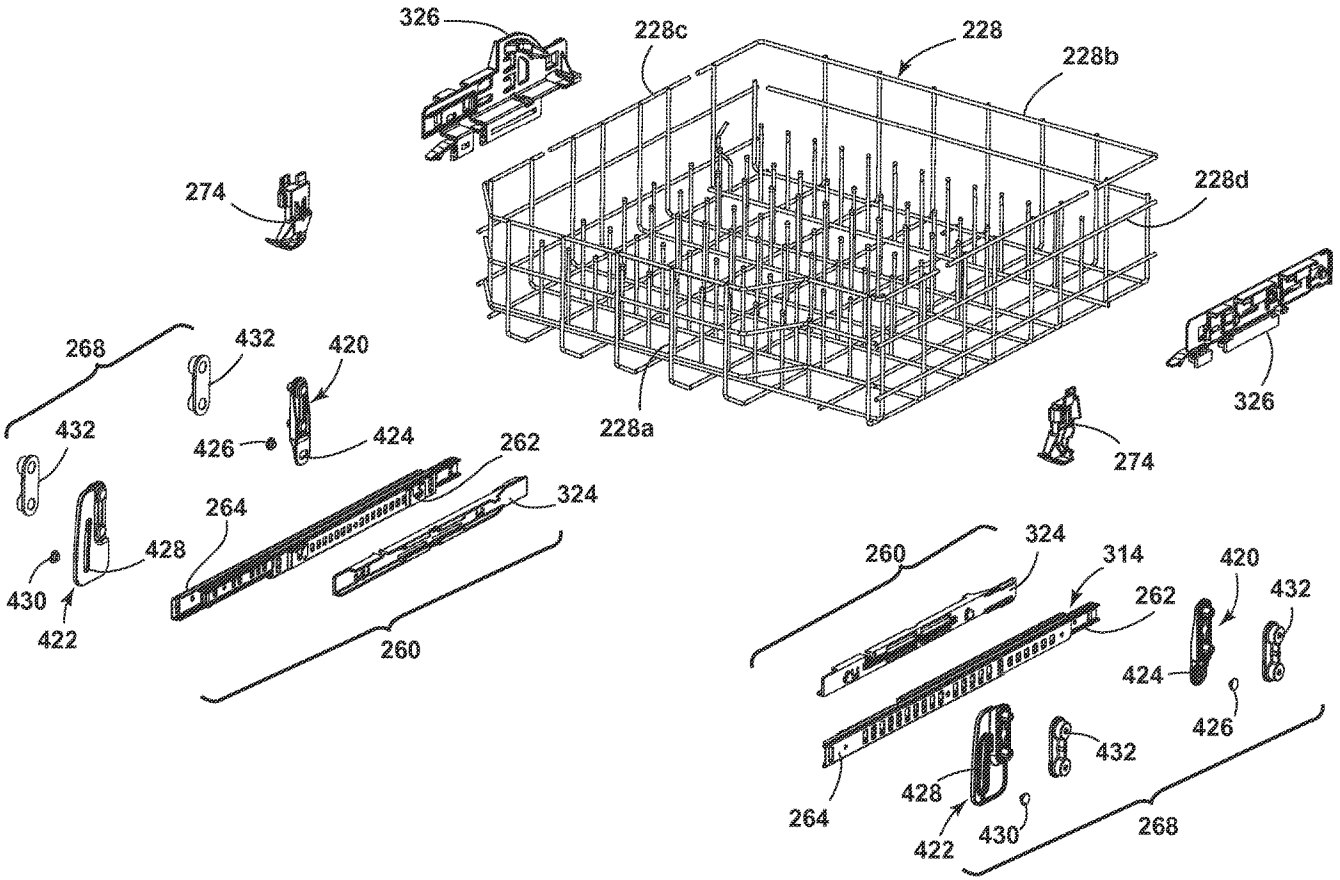
FIG. 9 is an exploded view of the dish rack pivot system of FIG. 8.

Referring now to FIG. 9, the slide system 260 may comprise a pair of slide system assemblies 314 with each assembly 314 including a first rail 262 and a second rail 264 in telescopic disposition, a first transition element 324 and a second transition element 326. The second rail 264 may be fixedly attached to the side wall 248 of the tub 214 within the treating chamber 216, and may telescopically support the first rail 262 to enable the first rail 262 to slidably move into and out of the treating chamber 216. The second transition element 326 may be configured for coupling the dish rack 228 with the slide assembly 314 through the first transition element 324. The first transition element 324 may be coupled with the first rail 262 through any suitable means having sufficient strength and durability for the purposes described herein. For example, the first transition element 324 may be coupled with the first rail 262 through fasteners, such as threaded fasteners, rivets, snap fittings, and the like, by welding, by integrating the first transition element 324 into the first rail 262, or through an assembly of rollers or bearings adapted for movement of the first transition element 324 along the first rail 262. The second transition element 326 may similarly be coupled with the dish rack 228 through any suitable means having sufficient strength and durability, non-limiting examples of which include fasteners such as threaded fasteners, rivets or snap fitting, welding, or by integrating the second transition element 326 with the dish rack 228.

Still referring to FIG. 9, the pivot system 268 may include a first pair of rear pivot assemblies 420 and an optional second pair of front pivot assemblies 422 for pivotally mounting each slide system assembly 314 to opposing side walls 248 of the tub 214. The rear pivot assemblies 420 are coupled to the tub side walls 248 adjacent a rear wall of the tub 214 opposite the open face 318 by a mounting bracket 432. The front pivot assemblies 422 are coupled to the tub side walls 248 adjacent the open face 318 of the tub 214 by a mounting bracket 432. The mounting bracket 432 used to couple the pivot assemblies 420, 422 with the tub 214 may be the same (as illustrated) or different.

The rear pivot assembly 420 includes a first rear pivot coupling 424 and a second rear pivot coupling 426 to pivotally couple the slide system assembly 314 to the tub 214. The first rear pivot coupling 424 may be in the form of an aperture or hub which may receive the second rear pivot coupling 426 in the form of an axle or pin for pivotable register. The first rear pivot coupling 424 may be horizontally elongated to enable the slide system assembly 314 to move longitudinally with respect to the tub 214 in addition to pivotal movement.

The front pivot assembly 422 includes a first front pivot coupling 428 and a second front pivot coupling 430. The first front pivot coupling 428 may be in the form of a channel which may receive the second front pivot coupling 430 in the form of an axle or pin for pivotable register. The first front pivot coupling channel 428 may extend vertically to enable the slide system assembly 314 to move vertically with respect to the tub 214 in addition to pivotal movement. The first front pivot coupling channel 428 may extend linearly or having a generally curved or arced cross-section, as illustrated.

Figure 10:
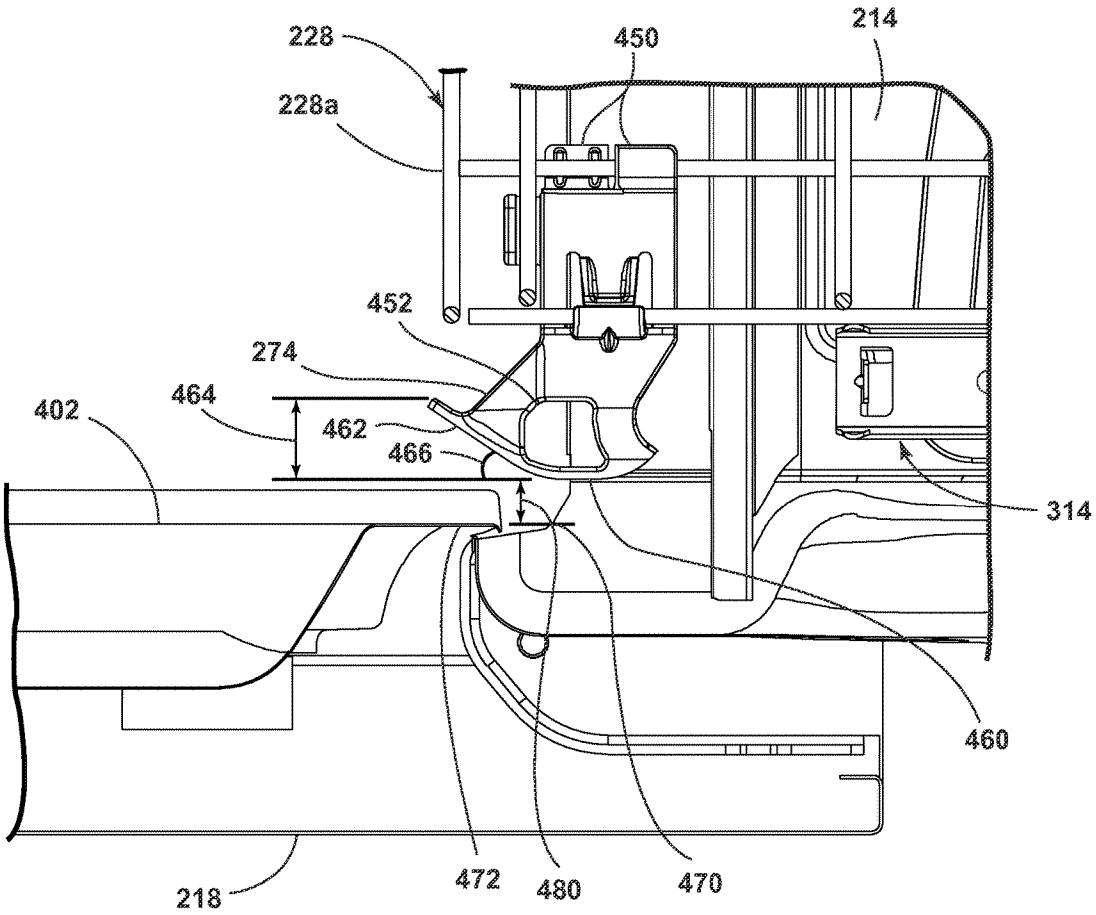
FIG. 10 is an enlarged cross-sectional view of the dishwasher of FIG. 8 illustrating the dish rack in a retracted position.

Referring now to FIG. 10, the dish rack 228 may also be provided with a contact element 274 for contact with the track 402 provided on the inner surface of the door assembly 218 to facilitate sliding the lower dish rack 228 along the door assembly 218. While the contact element 274 is described in the context of a ski-shaped element, it will be understood that the contact element 274 may have different shapes such as a ball, disk, or wheel assembly, for example. The contact element 274 may be made from a material that has a low coefficient of friction when sliding on the material used to form the track 402. An example of a suitable low friction material for sliding on a track made from a stainless steel material includes an acetal-based copolymer such as Celcon® M90™.

The contact element or ski 274 may be coupled with the dish rack 228 using any suitable mechanical or non-mechanical fastener, and is illustrated in FIG. 10 as being coupled with the wire elements of the dish rack 228 by a plurality of clips 450. The ski 274 may include one or more apertures 452 that function as wash-out ports to enable soil and debris that may accumulate on the ski 274 to be washed away during a cycle of operation.

The ski 274 may include a base portion 460 which is generally parallel with the slide system assembly 314 when the dish rack 228 is empty and in the fully retracted position within the treating chamber 216 (see FIG. 8). The ski 274 may also include a leading edge defining a ramp 462. The ramp portion 462 may extend from a forward end of the base portion 460 in the direction of the door assembly 218. The height 464 and angle 466 of the ramp portion 462 with respect to the base portion 460 may be configured to facilitate sliding of the ski 274 and transition of the ski 274 over a threshold between the tub open face 318 and the track 402 in the door assembly 218 under different dish rack load weights and distributions. As used herein the term load weight with reference to the dish rack 228 refers to the total weight of the dish rack 228 plus any items carried by the dish rack 228.

The dish rack 228 may be coupled with the slide system 260 such that the base portion 460 of the ski 274 is suspended above a horizontal plane 470 defined by a first portion 472 of the track 402 by a vertical height 480 for an unloaded, fully retracted dish rack 228. The slide system 260 is configured such that the ski 274 does not contact the track 402 when the dish rack 228 is slid in and out of the tub 214, but does contact the track 402 when the dish rack 228 is slid out from the treating chamber 216 and a distance between the ski 274 and the open face 318 satisfies a distance threshold. The term "satisfies" the threshold is used herein to mean that the distance satisfies the predetermined threshold, such as being equal to, less than, or greater than the threshold value. It will be understood that such a determination may easily be altered to be satisfied by a positive/negative comparison or a true/false comparison. For example, a less than threshold value can easily be satisfied by applying a greater than test when the data is numerically inverted.

While the distance threshold is described in the context of the distance between the ski 274 and the open face 318, it will be understood that the distance threshold may be based on the distance between the front wall 228*a* of the dish rack 228 and the open face, and may optionally may take into consideration the distance between the front wall 228*a* of the dish rack 228 and the ski 274. In addition, while the ski 274 is illustrated as being generally positioned adjacent the front wall 228*a* and side walls 228*c, d* of the dish rack 228, the ski 274 may be located anywhere between the side walls 228*c, d* and between the front and rear walls 228*a, b*. Furthermore, while a pair of skis 274 is illustrated, the dish rack 228 may include fewer or greater skis located at any desired position of the dish rack 228.

The dish rack pivot system may generally be considered as a cantilever system. As the load weight of the dish rack 228 increases and the distance to which the dish rack 228 is extended or slid out from the treating chamber 216 increases, the forces applied to the slide system 260 and pivot system 268, such as bending moments and shear forces, also increase, which may decrease the durability and reliability of the slide system 260 over time. In addition, the vertical height 480 of the base portion 460 of the ski 274 may decrease as the load weight of the dish rack 228 increases, the distance the dish rack 228 is extended increases and/or based on the load weight distribution in the dish rack 228.

The slide system 260 and pivot system 268 may be configured such that the ski 274 does not initially contact the track 402 as the dish rack 228 is slid out, even when loaded, but does eventually contact the track 402 when the distance threshold is satisfied. The distance threshold may be based on a load weight of the dish rack 228, the height 480 of the ski 274 under various loading conditions and/or based on the forces applied to the slide system 260 and pivot system 268 by the dish rack 228 as the dish rack 228 is slid in and out of the treating chamber 216. Thus, while it may be desirable to have the ski 274 positioned above the track 402 to facilitate ease of sliding the dish rack 228 in and out over a threshold between the open face 318 of the tub 214 and a bottom edge of the door assembly 218 or the door seal 400, it may also be desirable to have the dish rack 228 eventually contact the track 402. Contact between the track 402 and the ski 274 may facilitate smooth sliding of the dish rack 228 and may also support the weight of the dish rack, which may avoid the application of an undesirable type and/or amount of force on the slide system 260 and pivot system 268.

Consider an exemplary embodiment of the dish rack 228 in which a distance from the front wall 228*a* of the dish rack 228 in the fully extended position to the open face 318 of the tub 214 is 610 mm. A typical range of load weights for a lower dish rack based on user behavior may be in the range of 20-40 pounds, with 20 pounds being the most typical. The dish rack 228 may be coupled with the slide system 260 to position the ski 274 at a vertical height 480 above the track 402 such that the ski 274 does not initially contact the track 402 when the dish rack 228 is slid out, but does contact the track 402 within a distance that satisfies a predetermined distance threshold for load weights ranging from 0-40 pounds. In the exemplary embodiment, the distance threshold may be the first approximately 250 mm of travel of the front wall 228*a* of the dish rack 228 from the open face 318 of the tub 214. The distance threshold may be determined experimentally by testing the change in position and/or forces applied to the ski 274, slide system 260, and/or pivot system 268 under different load weights and distributions or using one or more algorithms based on empirical data.

The point at which the ski 274 contacts the track 402 may vary based on both the load weight and the manner in which the weight is distributed. The dish rack 228 may be coupled with the slide system 260 to position the ski 274 such that an empty dish rack 228 (i.e. zero load weight) contacts the track 402 at a predetermined location, 500 mm from the open face 318 of the tub 214. As the load weight increases from 10 to 20 to 30 pounds, for example, the ski 274 may contact the track 402 earlier along the path of travel. However, for a given load weight, such as 20 pounds, the ski 274 may contact the track 402 at different points along the track 402 based on the manner in which the weight is distributed within the track. Thus, a dish rack 228 having a load weight of 20 pounds primarily distributed in the front of the dish rack 228 may contact the track 402 earlier than a dish rack 228 having a load weight of 20 pounds evenly distributed within the dish rack 228. In addition, if the load weight is primarily distributed in the rear of the dish rack 228, the ski 274 may not contact as soon as would be expected for the same load weight evenly distributed within the dish rack 228. It is also possible that the uneven weight distribution toward the rear of the dish rack 228 may cause the ski 274 to contact the track 402 at a location that would be expected for a smaller load weight, including a zero load weight. It is also possible that the load may be so unequally distributed toward the rear of the dish rack 228 that the ski 274 does not contact the track 402 until a point even farther from the open face 318 than the point at which the ski 274 contacts the track 402 when the dish rack 228 is empty.

In one example, the distance threshold may be based on a vertical height 480 of the ski 274 in which the ski 274 passes over the threshold between the door assembly 218 and the open face 318 without contacting the track 402, but does eventually contact the track 402 for the entire desired range and distribution of load weights. In another example, alternatively or additionally, the distance threshold may be based on a distance such that the ski 274 contacts the track 402 prior to a predetermined location along the track 402, such as prior to an angled or ramped portion of the track 402 configured to slow the sliding withdrawal of the dish rack 228. In yet another example, alternatively or additionally, the distance threshold may be selected based on an amount and/or type of force applied to the slide system 260 and/or pivot system 268 to avoid or minimize application of an undesirable force during movement of the dish rack 228 over the desired range and distribution of load weights. In still another example, the distance threshold may be based on the point at which the ski 274 contacts the track 402 when the dish rack 228 has a predetermined load weight or is empty. For example, the distance threshold may be determined such that for a desired range and distribution of weight loads, the ski 274 contacts the track 402 prior to the point along the track 402 at which the ski 274 contacts the track 402 when the dish rack 228 is empty.

There may be cases within a range of load weights and/or distributions that the ski 274 does not contact the track 402 for certain load weights and distributions. For example, the ski 274 may not contact the track 402 at all when the dish rack 228 is empty or only has a small load, such as less than 10 pounds or may not contact the track 402 when the load weight is unevenly distributed towards the rear of the dish rack 228.

The height 464 and angle 466 of the ski 274 may be configured to facilitate sliding of the ski 274 and passage over the threshold desired range and distribution of load weights. For example, in cases where the dish rack 228 is loaded such that the front wall 228*a* of the dish rack 228 pivots or sags forwards and downwards, the height 464 and angle 466 of the ramp portion 462 may compensate for this motion to maintain the ski 274 at a vertical height 480 above the track 402 that will still clear the threshold as the dish rack 228 is slid out.

While the distance threshold is described in the context of the third embodiment of FIGS. 8-13, it is within the scope of the invention for the distance threshold to be used with the dishwashers of the first and second embodiments in a similar manner.

Figure 11:
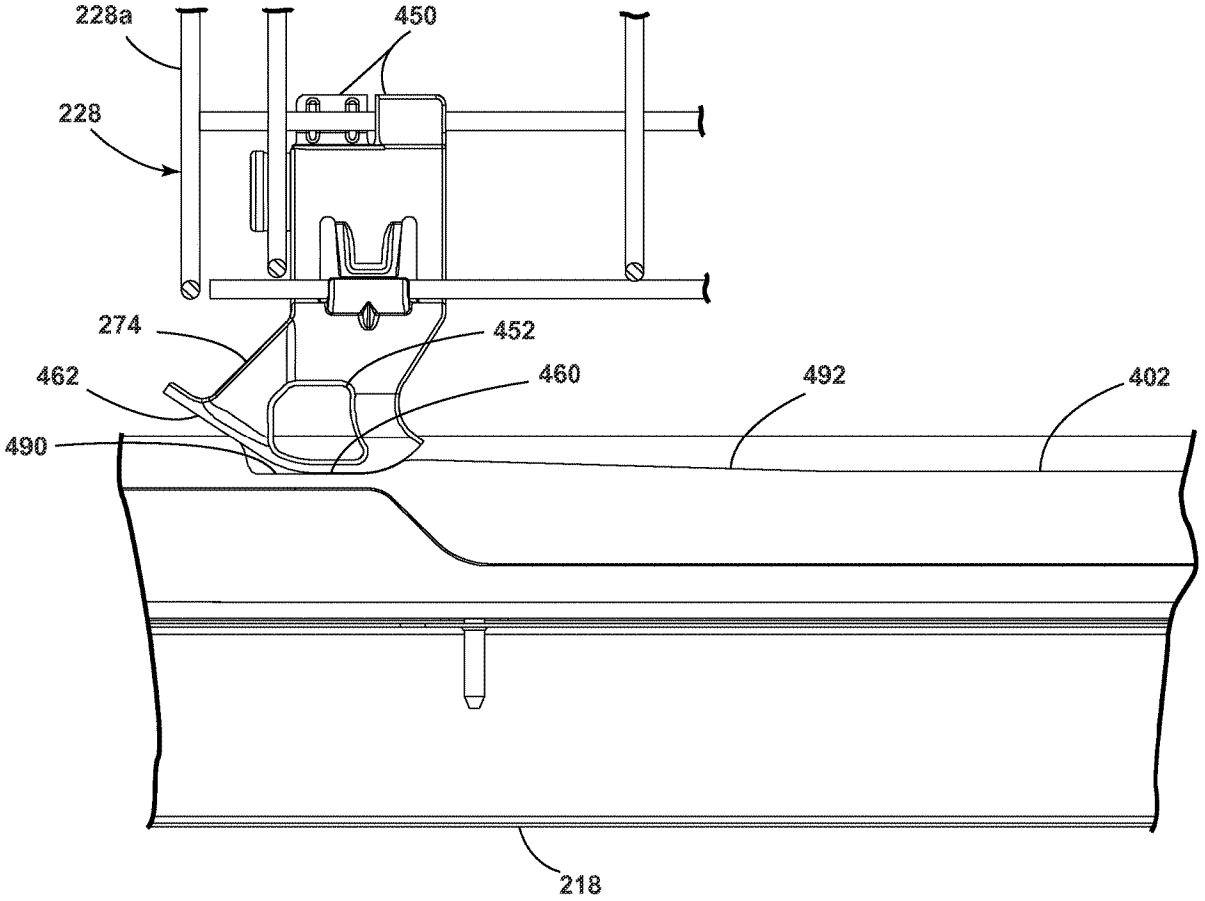
FIG. 11 is an enlarged cross-sectional view of the dishwasher of FIG. 8 illustrating the dish rack in an extended position.

Referring now to FIG. 11, the dish rack 228 is illustrated in the fully extended position. The track 402 in the door assembly 218 may include a stop 490 in the form of a groove or indentation at a terminal end of the track 402 to limit the extent to which the dish rack 228 may be withdrawn from the treating chamber 216. The track 402 may also include a second portion 492 leading up to the stop 490 that is angled with respect to the first portion 472. The second portion 492 may be angled, for example 2 degrees with respect to the first portion 472 to dampen the motion of the dish rack 228 as the dish rack 228 is slid out from the treating chamber 216 and may also facilitate sliding the dish rack 228 back into the treating chamber 216.

Figure 12:
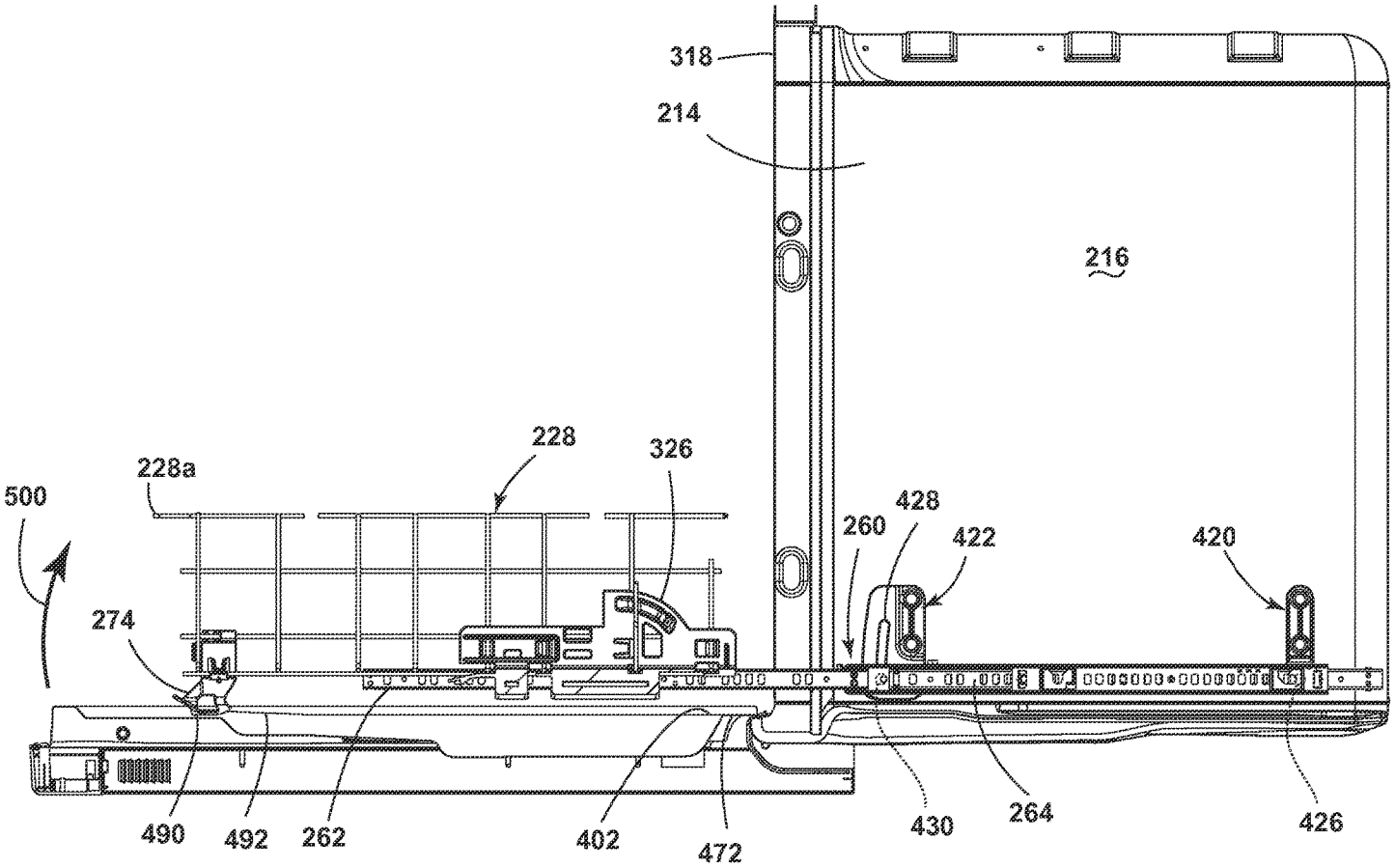
FIG. 12 is a schematic cross-sectional view of the dishwasher of FIG. 8 showing the dish rack, pivot system, and slide system in an un-pivoted configuration.
Figure 13:
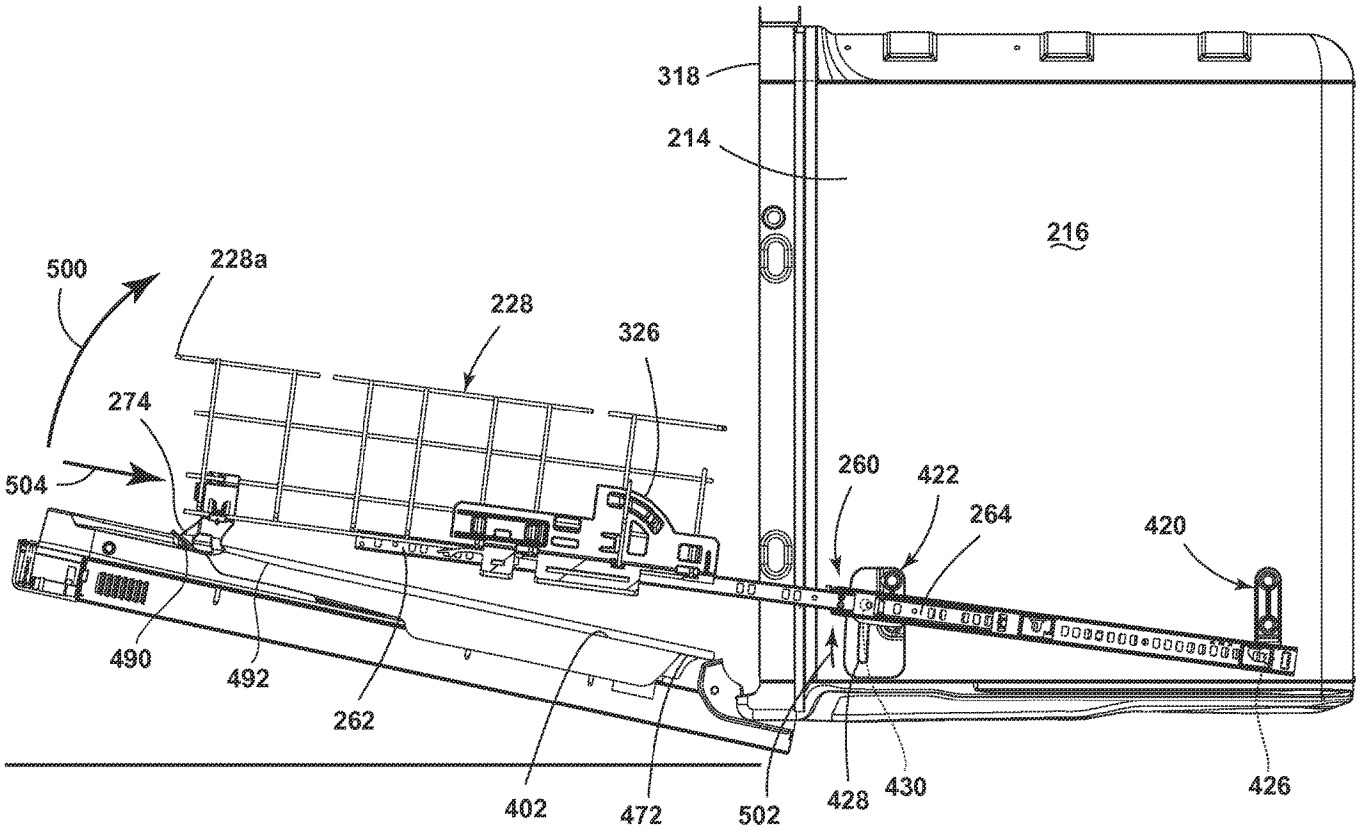
FIG. 13 is a schematic cross-sectional view of the dishwasher of FIG. 8 showing the dish rack, pivot system, and slide system in a pivoted configuration.

FIGS. 12 and 13 illustrate movement of the dish rack 228 when the door assembly 218 is pivoted from the open position to the closed position with the dish rack 228 extended and at least partially overlying the door assembly 218. While the movement is described in the context of the dish rack 228 being in the fully extended position in which the ski 274 is located within the stop 490 at the end of the track 402, it will be understood that the slide system 260 and pivot system 268 may operate in a similar manner when the dish rack 228 is only partially slid out of the treating chamber 216 with the ski 274 located anywhere along the length of the track 402. Because each pair of slide system 260 and pivot system 268 on each side of the dish rack 228 operate in the same manner, only one slide and pivot system 260 and 268 are illustrated and described.

Referring to FIG. 12, when the dish rack 228 is extended and overlies the door assembly 218 when the door assembly 218 is in the open position, the first rail 262 is at least partially telescopically extended with respect to the second rail 264 and the second front pivot coupling 430 is generally vertically aligned with the second rear pivot coupling 426. The door assembly 218 may be lifted upwards, as illustrated by arrow 500, to pivot the door assembly 218 into the closed position, even when the dish rack 228 overlies the door assembly 218.

As illustrated in FIG. 13, as the door is lifted upwards in the direction of arrow 500, the second rail 264 may pivot with respect to the tub 214 at the rear pivot assembly 420 and optionally also at the front pivot assembly 422. As the second rail 262 pivots with respect to the tub 214, the second front pivot coupling 430 may travel upwards within the first front pivot coupling channel 428, as indicated by arrow 502, such that the second front pivot coupling 430 is no longer vertically aligned with the second rear pivot coupling 426. As the door assembly 218 is moved to the closed position and the second rail 264 pivots with respect to the tub 214, the first rail 262 will telescopically slide with respect to the second rail 264 such that the dish rack 228 slides towards the treating chamber 216, as illustrated by arrow 504, into the retracted position. As the first rail 262 telescopically retracts, the ski 274 may travel out of the stop 490 and along the track 402. The angle of the second portion 492 of the track 402 may facilitate the sliding motion of the ski 274 along the track 402 as the first rail 262 retracts and the dish rack 228 slides into the treating chamber 218.

In a typical dishwasher, if a user attempts to close the door with the dish rack in the extended position overlying or partially overlying the door, the rack slide system will jam and prevent the user from closing the door, thus requiring the user to first push the dish rack into the retracted position before closing the door. In the embodiments described herein, the slide system is pivotally coupled with the tub such that the user may close the door, even when the dish rack is extended and fully or partially overlying the door, which may increase ease of use and user satisfaction with the dishwasher. In addition, the dish rack pivot systems described herein may decrease wear and tear on the slide system which may result from users attempting to force the door closed even when the dish rack is extended over the door.

Because loading of the lower dish rack may vary between loads and between users, the forces applied to the dish rack pivots systems described herein may also vary. It is desirable that the dish rack be able to slide in and out of the tub easily, without running into an edge of the door, over range of dish rack load weights and distributions. In a dish rack slide system in a typical dishwasher, as the load weight increases or if the load weight is unevenly distributed to the front of the dish rack, the front of the dish rack and/or any contact element on the dish rack may run into the edge of the door as the user attempts to slide the dish rack out of the tub, which may require the user to exert force to lift the dish rack upwards and over the edge of the door before proceeding with sliding the dish rack into the extended position. This type of exertion by the user may be cumbersome and undesirable.

The dish rack pivot systems described herein may be configured to allow the dish rack and contact element to slide out of the tub and over the threshold between the open face of the tub and the edge of the door over a range of different load weights and load weight distributions. However, because the slide system is essentially a cantilever system, the dish rack and dish rack load applies forces to the slide system and pivot system typically found in a cantilever system, such as bending moments and shear forces. The load weight of the dish rack, weight distribution of the dish rack and the extent to which the slide system is extended when the dish rack is slid out may each effect the forces applied to the dish rack pivot system. In some cases, the forces applied may be undesirable and affect the reliability and operation of the dish rack pivot system over time.

The dish rack pivot systems described herein may be configured to position the contact element above the dishwasher door such that the contact element and dish rack clear the threshold between the open face of the tub and the door for a range of dish rack load weights and distributions, but then does eventually contact the door. The location at which the contact element eventually contacts the door may be a distance that avoids applying an undesired type or amount of force to the slide or pivot system. Additionally, or alternatively, the location at which the contact element contacts the door may be based on a contact element position that clears the threshold for the entire desired range of load weights and distributions such that the contact element will contact the door at some point along the distance of travel of the dish rack, such as prior to an angled portion designed to dampen the withdrawal of the dish rack. Having the contact element contact the door such that the door at least partially supports some of the weight of the dish rack not only relieves some of the forces applied to the dish rack pivot system, but may also facilitate sliding of the dish rack in and out of the tub along the track in the door, and in particular when the door is closed with the dish rack overlying the door, as described above.

To the extent not already described, the different features and structures of the various embodiments of the invention may be used in combination with each other as desired. For example, one or more of the features illustrated and/or described with respect to one of the slide systems 60, 92, and 260 and pivot systems 68, 90, and 268 can be used with or combined with one or more features illustrated and/or described with respect to the other of the slide systems 60, 92, and 260 and pivot systems 68, 90, and 268. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher for treating dishes according to a cycle of operation, comprising:

a tub at least partially defining a wash chamber with an open face;

a door moveable between an open position and a closed position about a pivot axis for selectively opening and closing the open face and having at least one track provided on an inner face of the door;

a dish rack configured to hold dishes to be treated and defined at least in part by a front wall;

a slide system slidably coupling the dish rack to the tub for sliding movement of the dish rack in and out of the wash chamber through the open face between a fully retracted position in which the dish rack lies within the wash chamber and a fully extended position in which the dish rack overlies at least a portion of the door;

a pivot system pivotally coupling at least one of the dish rack or the slide system to the tub to enable cooperative pivoting of the dish rack and door when the dish rack is at least partially overlying the door and the door is pivoted from the open position to the closed position; and at least one contact element provided on a front portion of the dish rack and having a base portion configured for contact with the track;

wherein the slide system and the pivot system couples the dish rack to the tub such that when the door is in the open position, as the dish rack is slid out of the wash chamber through the open face, the base portion of the at least one contact element does not initially contact the door, but the base portion of the at least one contact element does contact the door when a distance between the at least one contact element and the open face satisfies a distance threshold and wherein the at least one track is aligned with the at least one contact element such that the base portion of the at least one contact element slides along at least a portion of the at least one track when the distance threshold is satisfied; and wherein the distance threshold is less than a distance from the front wall of the dish rack in the fully extended position to the open face of the tub and greater than a threshold between the door and the open face of the tub; and wherein when the dish rack at least partially overlies the door and the door is moved from the open position to the closed position, the at least one contact element slides along the at least one track while the pivot system allows the dish rack to pivot with respect to the tub to inhibit jamming of the slide system as the dish rack moves into the fully retracted position as the door is moved into the closed position.

2. The dishwasher of claim 1 wherein the distance threshold is based on at least one of a type or amount of force applied to the slide system.

3. The dishwasher of claim 1, further comprising a seal fluidly sealing the door with the open face of the tub.

4. The dishwasher of claim 3 wherein the at least one contact element passes over the seal when the dish rack is slid in and out of the wash chamber.

5. The dishwasher of claim 3 wherein the seal comprises a gap through which the at least one contact element passes as the dish rack is slid in and out of the wash chamber.

6. The dishwasher of claim 1 wherein the at least one track comprises a first portion and a second portion with the second portion formed at an angle with respect to the first portion.

7. The dishwasher of claim 1 wherein the at least one track comprises a stop at a terminal end of the at least one track to limit a distance the at least one contact element can travel along the at least one track.

8. The dishwasher of claim 1 wherein the base portion has a leading edge defining a ramp portion for sliding movement of the at least one contact element relative to the door.

9. The dishwasher of claim 8 wherein the ramp portion is formed at an angle with respect to the base portion.

10. The dishwasher of claim 9 wherein the angle is based on a vertical distance between the base portion and an edge of the door adjacent the open face of the tub when the door is in the open position.

11. The dishwasher of claim 1 wherein the pivot system comprises at least one pivot assembly pivotally coupling the slide system with the tub.

12. The dishwasher of claim 11 wherein the slide system comprises first and second rails, which are slidably interconnected for relative sliding, the second rail being coupled to the at least one pivot assembly.

13. The dishwasher of claim 12 wherein the at least one pivot assembly comprises a mounting element pivotally coupling the second rail to the tub.

14. The dishwasher of claim 12 wherein the at least one pivot assembly comprises a first pivot assembly and a second pivot assembly pivotally coupling the second rail to the tub.

15. The dishwasher of claim 14 wherein the first pivot assembly couples the second rail to the tub for pivotal and longitudinal movement of the second rail relative to the tub.

16. The dishwasher of claim 15, wherein the second pivot assembly couples the second rail to the tub for pivotal and vertical movement of the second rail relative to the tub.

17. The dishwasher of claim 12 wherein the slide system further comprises a transition element mounted to the first rail to couple the dish rack with the first rail.

18. The dishwasher of claim 1 wherein the at least one contact element comprises a wheel for at least one of rolling or sliding movement relative to the door.

19. A dishwasher for treating dishes according to a cycle of operation, comprising:

a tub at least partially defining a wash chamber with an open face;

a door moveable between an open position and a closed position about a pivot axis for selectively opening and closing the open face;

a dish rack configured to hold dishes to be treated and defined at least in part by a front wall;

a slide system slidably coupling the dish rack to the tub for sliding movement of the dish rack in and out of the wash chamber through the open face between a fully retracted position in which the dish rack lies within the wash chamber and a fully extended position in which the dish rack overlies at least a portion of the door;

a pivot system pivotally coupling at least one of the dish rack or the slide system to the tub to enable cooperative pivoting of the dish rack and door when the dish rack is at least partially overlying the door and the door is pivoted from the open position to the closed position; and at least one contact element provided on a front portion of the dish rack and having a lowermost base portion;

wherein the slide system and the pivot system couples the dish rack to the tub such that when the door is in the open position, as the dish rack is slid out of the wash chamber through the open face, the lowermost base portion of the at least one contact element does not initially contact the door and is instead suspended above a horizontal plane defined by an inner face of the door, but the lowermost base portion of the at least one contact element does contact the door when a distance between the at least one contact element and the open face satisfies a distance threshold, and wherein the at least one contact element slides along at least a portion of an inner face of the door when the distance threshold is satisfied;

wherein the distance threshold is less than a distance from the front wall of the dish rack in the fully extended position to the open face of the tub and greater than a threshold between the door and the open face of the tub, and wherein when the dish rack at least partially overlies the door and the door is moved from the open position to the closed position, the at least one contact element slides along the inner face of the door while the pivot system allows the dish rack to pivot with respect to the tub to inhibit jamming of the slide system as the dish rack moves into the fully retracted position as the door is moved into the closed position.

20. A dishwasher for treating dishes according to a cycle of operation, comprising:

a tub at least partially defining a wash chamber with an open face;

a door moveable between an open position and a closed position about a pivot axis for selectively opening and closing the open face;

a dish rack configured to hold dishes to be treated and defined at least in part by a front wall;

a slide system slidably coupling the dish rack to the tub for sliding movement of the dish rack in and out of the wash chamber through the open face between a fully retracted position in which the dish rack lies within the wash chamber and a fully extended position in which the dish rack overlies at least a portion of the door;

a pivot system pivotally coupling at least one of the dish rack or the slide system to the tub to enable cooperative pivoting of the dish rack and door when the dish rack is at least partially overlying the door and the door is pivoted from the open position to the closed position; and at least one contact element provided on a front portion of the dish rack and where the at least one contact element comprises a ski having a leading edge defining a ramp portion and wherein the ramp portion is to facilitate transition of the ski over a threshold between the open face of the tub and an inner face of the door under different dish rack load weights and distributions;

wherein the slide system and the pivot system couples the dish rack to the tub such that when the door is in the open position, as the dish rack is slid out of the wash chamber through the open face, the at least one contact element does not initially contact the door, but the at least one contact element does contact the door when a distance between the at least one contact element and the open face satisfies a distance threshold, wherein the distance threshold is less than a distance from the front wall of the dish rack in the fully extended position to the open face of the tub and greater than a threshold between the door and the open face of the tub, and wherein the at least one contact element slides along at least a portion of the inner face of the door when the distance threshold is satisfied, and wherein when the dish rack at least partially overlies the door and the door is moved from the open position to the closed position, the leading edge of the at least one contact element slides along the inner face of the door while the pivot system allows the dish rack to pivot with respect to the tub to inhibit jamming of the slide system as the dish rack moves into the fully retracted position as the door is moved into the closed position.

* * * * *